United States Patent [19]

Weitz

[11] Patent Number: 4,781,847

[45] Date of Patent: Nov. 1, 1988

[54] AQUEOUS LUBRICANT

[75] Inventor: Gene C. Weitz, Stillwater, Minn.

[73] Assignee: American Polywater Corporation, Stillwater, Minn.

[21] Appl. No.: 859,320

[22] Filed: May 8, 1986

[51] Int. Cl.[4] ..... C10M 173/02

[52] U.S. Cl. ..... 252/49.3; 252/49.5; 252/51.5 R; 252/52 A; 252/56 R

[58] Field of Search ..... 252/49.5, 49.3

[56] References Cited

U.S. PATENT DOCUMENTS

| | | | |
|---|---|---|---|
| 2,825,693 | 3/1958 | Beaubien et al. | 252/32.5 |
| 2,826,549 | 3/1958 | Manteuffel | 252/49.5 |
| 2,958,659 | 11/1960 | Brown | 252/18 |
| 3,071,543 | 1/1963 | McGee | 252/49.5 |
| 3,227,652 | 1/1966 | Ackerman | 252/49.5 |
| 3,418,157 | 12/1968 | Katzer | 252/49.3 |
| 3,556,996 | 1/1971 | Jones et al. | 252/42.1 |
| 3,699,057 | 10/1972 | Halko et al. | 252/49.3 |
| 3,847,828 | 11/1974 | Latos | 252/49.5 |
| 3,925,216 | 12/1975 | Moorhouse | 252/49.3 |
| 3,933,660 | 1/1976 | Tadenuma et al. | 252/49.5 |
| 4,111,820 | 9/1978 | Conti | 252/49.5 |
| 4,461,712 | 7/1984 | Jonnes | 252/49.3 |
| 4,522,733 | 6/1985 | Jonnes | 252/49.3 |
| 4,563,294 | 1/1986 | Geymayer et al. | 252/49.3 |
| 4,673,516 | 6/1987 | Berry | 252/49.6 |

OTHER PUBLICATIONS

Union Carbide Technical Bulletin, Polyox®, *Water-Soluble Resins Are Unique.*

B.F. Goodrich Technical Bulletin, Carbopol®, *Water-Soluble Resins.*

*Primary Examiner*—William R. Dixon, Jr.
*Assistant Examiner*—E. McAvoy
*Attorney, Agent, or Firm*—Merchant, Gould, Smith, Edell, Welter & Schmidt

[57] ABSTRACT

An improved aqueous gel lubricant comprising water and about 0.5 to 25 wt-% of at least one 200 to 8,000 molecular weight polyalkylene glycol such as polyethylene glycol and polypropylene glycol. Preferably, the lubricant further comprises about 0.01 to 10 wt-% viscosity modifier such as a water soluble resin, natural gum, or cellulosic compound. The lubricant may further contain an effective antioxidizing, preserving, solvating, suspending and freezing point depressing amount of a hydroxy compound.

25 Claims, No Drawings

AQUEOUS LUBRICANT

FIELD OF THE INVENTION

The invention relates to aqueous gel lubricants useful in a variety of applications. More specifically, the invention relates to aqueous gel lubricants particularly useful in the installation of electrical and telephone cable in conduit.

BACKGROUND OF THE INVENTION

A lubricant for lubricating the interface between two surfaces intended to move relative to one another must meet a number of requirements to be useful. The lubricant must be essentially chemically and physically inert with respect to both surfaces. The lubricant must sufficiently reduce the force required to move one surface past the other. And, the lubricant must be in a form that permits easy application of the lubricant to one or both surfaces.

The first of such lubricants were composed of natural fats and oils typically thickened with clay or chalk. With the advent of the petroleum industry lubricating oils and greases were prepared from heavy petroleum fractions. The petroleum based lubricating oils offered many advantages over prior lubricants and in many application are still the lubricant of choice. However, in many applications petroleum based lubricants are undesirable as they can adversely interact with many substances such as plastics and rubbers, can be difficult to clean up, can remain in place well after application and can be unpleasant to workmen.

In view of the drawbacks which petroleum based lubricants present in certain applications, water based lubricants were developed. Many compounds have been used in preparing aqueous lubricants such as high molecular weight polyalkylene oxide polymers, fatty acid soaps, acrylate polymers, waxes, alkylene glycols, guar gum, Irish moss, carboxymethyl cellulose, phenolic and amine-formaldehyde resins, hydrocarbon sulfonic acids, gelatin, polyurethanes, borax, and others. See for example U.S. Pat. Nos. 2,958,659; 3,227,652; 3,699,057; 3,925,216; 4,111,800; 4,111,820; 4,461,712; and 4,522, 733. Aqueous based lubricants are generally less reactive, easier to clean, easier to apply and more agreeable to use than petroleum based lubricants.

To the best of my knowledge aqueous based lubricants containing many of the above mentioned compounds can suffer certain disadvantages. The lubricant compositions can be stiff, can be nonthixotropic, can be hard to handle and apply to the surface, can fail to sufficiently reduce the coefficient of friction under a broad load range, can fail to provide sufficient dry lubrication to facilitate subsequent movement of the surfaces relative to one another, can bond the surfaces together upon drying, can adversely interact with many substances and can be expensive.

Accordingly a need exists for an inexpensive substantially inert aqueous lubricant that can be easily handled, easily applied, easily cleaned, provide effective lubrication both before and after drying and provide a low coefficient of friction under heavy or light load.

BRIEF DISCUSSION OF THE INVENTION

I have discovered an inexpensive aqueous gel lubricant that has the ability to reduce the coefficient of friction between contacting surfaces under a variety of loads. The lubricant is a substantially inert aqueous gel that is easy to handle, easy to apply, easy to clean, provides excellent lubrication under both high and low load conditions, leaves little residue upon evaporation of the liquid phase, is slow in evaporating, provides effective dry lubrication, is substantially freezethaw stable, is agreeable to workmen, can be pumped, has an extended shelf life, is substantially nonflammable, and may be usefully employed in an aqueous environment.

My improved lubricant is an aqueous gel comprising water and an effective lubricating amount of at least one 200 to 15,000 molecular weight polyalkylene glycol compounds including homopolymers, block and random copolymers and terpolymers. Preferably, the lubricant further comprises an effective gelling amount of a viscosity modifier such as a water soluble resin, a natural gum, a cellulosic compound and mixtures thereof. The lubricant may further comprise an effective antioxidizing, preserving, solvating, suspending and freezing point depressing amount of a hydroxy compound.

DETAILED DESCRIPTION OF THE INVENTION INCLUDING A BEST MODE

My improved aqueous gel lubricant comprises water and an effective lubricating amount of at least one 200 to 15,000 molecular weight polyalkylene glycol compounds including homopolymers, block and random copolymers and terpolymers. Preferably, the lubricant comprises about 0.5 to 25 wt-% polyalkylene glycol and most preferably about 0.5 to 10 wt-% polyalkylene glycol. I have discovered that the dry lubricity of the lubricant is improved as the molecular weight of the polyalkylene glycol increases and if the polyalkylene glycol is used in amounts greater than about 1 wt-%.

The lubricant preferably further comprises an effective gelling amount of a viscosity modifier. A nonexhaustive list of useful viscosity modifiers includes water soluble resins such as acrylate polyelectrolyte compounds having a molecular weight greater than about 1,000, polyalkylene oxide compounds having a molecular weight greater than about 100,000 and polyacrylamide compounds having a molecular weight greater than about 100,000; natural gums such as gum agar and guar gum; and cellulosic compounds such as carboxymethyl cellulose, hydroxyethyl cellulose and hydroxymethyl cellulose. The lubricant preferably comprises about 0.01 to 10 wt-% viscosity modifier, most preferably about 0.5 to 2 wt-% viscosity modifier. The lubricant may also contain a hydroxy compound.

Polyalkylene Glycol

Polyalkylene glycols that can be used in forming the aqueous lubricant composition of the present invention, include polymeric polyalkylene glycol compounds. Such compounds include homopolymers, block and random copolymers, and terpolymers having a molecular weight between about 200 to 15,000. Preferred polyalkylene glycols are homopolymers having a molecular weight between about 400 to 4,000. The most preferred polyalkalene glycols are polyethylene and polypropylene glycols and mixtures thereof.

Aqueous solutions of polyalkylene glycols can produce surprisingly large reductions in the force needed to move surfaces past one another. Polyalkylene glycols are tolerant of electrolytes, can be combined with many other types of compounds, may be chosen so as to be substantially non-volatile, and are substantially nontoxic.

Viscosity Modifier

The improved aqueous gel lubricants of the present invention preferably include an effective gelling amount of a viscosity modifier to aid in application of the lubricant. A nonexhaustive list of useful viscosity modifiers includes the preferred water soluble resins such as acrylate polyelectrolyte compounds having molecular weights greater than about 1,000, polyalkylene oxide compounds having molecular weights greater than about 100,000, and polyacrylamide compounds having molecular weights greater than about 100,000; natural gums such as gum agar and guar gum; and cellulosic compounds such as carboxymethyl cellulose, hydroxymethyl cellulose, and hydroxyethyl cellulose. One of the most preferred groups of viscosity modifiers is mixtures of water soluble resins such as about 10–80 wt-%, based upon the viscosity modifier, acrylate polyelectrolyte compound having a molecular weight greater than about 3,000 and 20–90 wt-%, based upon the viscosity modifier, polyalkylene oxide compound having a molecular weight greater than about 300,000. A second most preferred group of viscosity modifiers is mixtures of water soluble resins and cellulosic compounds such as about 10–80 wt-%, based upon the viscosity modifier, acrylate polyelectrolyte compound having a molecular weight greater than about 3,000, about 0–90 wt-% polyalkylene oxide compound having a molecular weight greater than 300,000, about 0–90 wt-%, based upon the viscosity modifier, polyacrylamide compound having a molecular weight greater than about 100,000, and about 20–90 wt-%, based upon the viscosity modifier, cellulosic compound.

ACRYLATE POLYELECTROLYTE COMPOUND

Acrylate polyelectrolyte compounds that can be used in forming the aqueous lubricant of the present invention include polyelectrolyte polymers and both random and block copolymers having a molecular weight in excess of about 1,000, and preferably about 3,000 to 10,000,000.

Preferred polyelectrolyte polymers are derived from the polymerization of at least one polymerizable acrylate monomer having an ethylenically unsaturated group and a hydrophilic acidic group having the ability to maintain an ionized electrical charge in solution. A nonexhaustive list of useful hydrophilic acid group monomers includes carboxylic acids, carboxylic acid anhydrides, carboxylic acid halides, and mixtures thereof. Most preferred organic polymeric acrylate-type polymers are those made from carboxylic acid containing monomers which form polyelectrolyte polymers having an anionic nature. Useful monomers include acrylic acid, acrylic acid esters and salts, methacrylic acid and methacrylic acid ester salts, alpha-beta unsaturated dicarboxylic anhydride compounds such as maleic anhydride, itaconic acid, citriconic acid, etc. In addition to the acidic carboxyl containing monomers, other monomers, which do not interfere with the polyelectrolyte or carboxylic acid nature of the polymer, may be employed. A nonexhaustive list of such comonomers includes styrene, vinyl acetate, vinyl chloride, vinyl ethers, ethylene, isobutylene, etc.

The most preferred polyelectrolyte comprises polyacrylic acid having a molecular weight of at least about 3,000, represented by the formula:

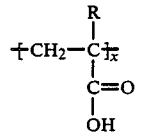

Polyacrylic acid polymers can be efficient gelling agents for aqueous solutions, are low in toxicity, do not increase frictional force and are generally compatible with other components in aqueous solution.

POLYALKYLENE OXIDE COMPOUND

Polyalkylene oxide compounds that can be used in forming the aqueous lubricant of the present invention are well known polymeric and co-polymeric compounds formed by polymerizing alkylene oxide compounds such as ethylene oxide, propylene oxide, butylene oxide, etc. Preferred polyalkylene oxide compounds comprise polyethylene oxide, polypropylene oxide, polyethylene glycol, polypropylene glycol, etc. A more preferred compound comprises a polyethylene oxide compound having a molecular weight from about $3\times10^5$ to about $4\times10^6$, represented by the formula:

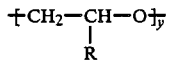

Wherein y is $(1\times10^4)$ to $(3\times10^5)$. Most preferred are polyethylene oxide compounds having a molecular weight of about $2\times10^6$ to $6\times10^6$.

In addition to acting as a viscosity modifier, polyalkylene oxide compounds can produce significant reductions in the force needed to move surfaces past one another at concentrations as little as 0.003%. Polyalkylene oxide compounds are generally tolerant of electrolytes, can be combined with many other types of compounds, and have low toxicity.

POLYACRYLAMIDE COMPOUND

Polyacrylamide compounds that can be used in forming the aqueous lubricant of the present invention are well known polymeric and copolymeric compounds formed by polymerizing an acrylamide-type monomer of the formula:

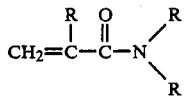

wherein R is independently a $C_{1-10}$ alkyl. Such monomers include acrylamide, propionic acid amide, methacrylamide (2-methyl-propionic acid amide), etc. Copolymers may be made by copolymerizing the acrylamide monomer with other acrylic monomers such as acrylic acid, methacrylic acid, methyl acrylate, methyl methacrylate, etc. Preferred polyacrylamide polymers are homopolymers of acrylamide represented by the formula:

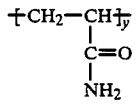

wherein y is $1\times10^3$ to $3\times10^5$. Copolymers of acrylamide and an acrylic or methacrylic monomer, having a molecular weight of about $1\times10^5$ to $10\times10^6$ are most preferred. The preferred polymers contain sufficient acrylic monomer to produce a low, medium or high anionic functionality from the pendant carboxyl groups.

In addition to acting as a viscosity modifier, polyacrylamide polymers can produce significant reductions in the force needed to move surfaces past one another at concentrations as little as 0.003%. Polyacrylamide polymers are generally tolerant of electrolytes, can be combined with many other types of compounds and have low toxicity.

CELLULOSIC COMPOUND

Cellulosic compounds that can be used in forming the aqueous lubricant of the present invention include purified natural cellulose and derivatives thereof. Natural cellulose is composed of anhydral glucose units and is the major constituent of the cell walls of trees and other higher plants. Purified cellulose may be refined from plant material, mainly trees and cotton, in any of several well known purification processes. A brief but thorough discussion of some of these purification processes may be found in Kirk-Othmer, *Encyclopedia of Chemical Technology,* 2nd Ed., Vol. 6, pp. 608–610.

Cellulose is a well known viscosity modifier which rapidly increases the viscosity of a solution to which it is added. Cellulosics are generally tolerant of electrolytes, can be combined with many other types of compounds, have low toxicity and have been found to have synergistic viscosity modifying properties when combined with many other viscosity modifiers such as water soluble resins, particularly acrylate polymers.

HYDROXY COMPOUNDS $C_{1-6}$ hydroxy compounds having from 1 to 3 hydroxy groups may be used in the aqueous lubricant of the present invention as an antioxidizing, preserving, solvating, suspending and freezing point depressing agent. A non-limiting list of such hydroxy compounds includes methanol, ethanol, ethylene glycol, propanol, isopropanol alcohol, propylene glycol, glycerine, n-butanol, isobutanol, tertiary butanol, amyl alcohol, isoamyl alcohol, n-hexanol, t-hexanol, cyclohexanol, etc. Preferred hydroxy compounds include methanol, ethanol, isopropanol, and propylene glycol. Most preferred hydroxy compounds for reasons of availability and solvent power are isopropanol and propylene glycol.

In particular applications it may be possible to replace much of the water with a hydroxy compound such as where maximum freezing protection is desired.

The aqueous gel lubricant may be applied to surfaces requiring lubrication using various means such as hand application, flow coating, spraying, or immersion. In such applications lubricant temperature may vary widely from about −20° C. up to about 70° or 80° C. Typical temperatures for application by immersion are commonly within the range of about 5° C. to 40° C. In the case of lubricating conduit and cable, we have found that the lubricant can be evenly distributed on the inside surface of the conduit using a variety of methods including by hand or by any of a number of automatic machines designed just for that purpose.

A preferred method for evenly distributing the lubricant into a conduit is disclosed in U.S. Ser. No. 06/820,439 filed Jan. 17, 1986.

After application and installation of cable and conduit, we have found that the water present in the cable lubricant compound slowly evaporates, leaving a residue comprising polyalkylene glycol and viscosity modifier. One advantage of the invention is that the residue maintains substantial lubricating properties which can be very useful in maintenance of cable installations for some time after installation is complete. Further, evaporation of the liquids from the lubricant is slow even in environments where ambient temperature is high.

In addition to the components which have been set forth above, the lubricant compositions of the present invention may also contain a variety of well known additives such as dyes, colorants, perfumes, preservatives, corrosion inhibitors, etc. When used, these additives can be present in amounts of about 0.01 to 5 wt-% of the composition and are preferably present in amounts of about 0.1 to about 3 wt-% of the composition.

EXAMPLE I

Into a one liter glass beaker was placed 954.2 grams of room temperature deionized water into which 0.6 grams polyacrylic acid having a molecular weight of about 4,000 (CARBOPOL 940, B. F. Goodrich Co.) was slowly added. The mixture was stirred under ambient conditions until the CARBOPOL dissolved and a smooth mixture was obtained. Into a separate one liter glass beaker was placed 20 ml propylene glycol, 10 ml polyethylene glycol having a molecular weight of about 200 and 10 ml polypropylene glycol having a molecular weight of about 1,200 into which 5 grams polyacrylamide having a molecular weight of greater than 10,000,000 (RETEN 523, Hercules, Inc.) was slowly added. The RETEN mixture was stirred until a stable slurry was formed. Into the beaker containing the CARBOPOL solution was placed the RETEN mixture and 0.25 grams of sodium hydroxide with the resultant mixture vigorously agitated until a smooth clear gel was obtained.

EXAMPLE II

Into a one liter glass beaker was placed 967.6 grams of room temperature deionized water into which 3.5 grams of polyacrylic acid having a molecular weight of about 4,000 (CARBOPOL 940, B. F. Goodrich Co.) and 2 grams hydroxyethyl cellulose (CELLOSIZE QP 100,000, Union Carbide) was slowly added. The mixture was stirred under ambient conditions until the CARBOPOL dissolved and a smooth mixture was obtained. Into a separate one liter glass beaker was placed 10 ml polyethylene glycol having a molecular weight of about 200 and 15 ml polypropylene glycol having a molecular weight of about 4,000 into which 0.5 grams of polyacrylamide oxide having a molecular weight greater than 10,000,000 (RETEN 523, Hercules, Inc.). The RETEN mixture was stirred until a stable slurry was formed. Into the beaker containing the CARBOPOL solution was placed the RETEN mixture and 1.44 grams of sodium hydroxide with the resultant mixture vigorously agitated until a smooth white gel was obtained.

EXAMPLE III

Into a one liter glass beaker was placed 969.8 grams of room temperature deionized water to which 4.25 grams polyacrylic acid having a molecular weight of about 4,000 (CARBOPOL 940, B. F. Goodrich Co.)

and 4.25 grams cellulose (CELLOSIZE QP 100,000, Union Carbide) was slowly added. The mixture was stirred under ambient conditions until the CARBOPOL dissolved and a smooth mixture was obtained. Into a separate one liter glass beaker was placed 10 ml of polyethylene glycol having a molecular weight of about 200 and 10 ml of polypropylene glycol having a molecular weight of about 4,000. Into the beaker containing the CARBOPOL solution was placed the glycol mixture and 1.74 grams sodium hydroxide under vigorous agitation until a smooth white gel was obtained.

EXAMPLE IV

An excess of lubricant formed in accordance with the procedure of Example I was coated onto 6-inch long 0.75 inch outside diameter polyethylene jacketed optical fiber cable made by Siecor and 6-inch long 0.50 inch outside diameter polyethylene jacketed optical fiber cable made by Western Electric. Utilizing the apparatus and method described in Weitz, G., "Coefficient of Friction Measurement Between Cable and Conduit Surfaces Under Varying Normal Loads", IEEE Transactions Power Apparatus & Systems, Vol. PAS-104, No. 1, January, 1985, Paper No. 84 T&D 375-2, the coated cables were each pulled through 1.25 inch inside diameter conduits made of polyethylene and polyvinyl chloride. A sidewall force of 100 lb/ft was applied. The static ($u_S$) and kinetic ($u_K$) coefficients of friction were calculated for each cable and conduit combination. Results of the tests are tabulated in Table 1.

For comparison purposes, the static and kinetic coefficients of friction for the same cables and conduits were calculated for nonlubricated cable utilizing the apparatus and method disclosed above. However, because the apparatus was not equipped with sufficient pulling force to move the nonlubricated cable under 100 lbs./ft. sidewall force (maximum pulling force about 30 lbs.) the coefficients of friction were calculated under a smaller sidewall force.

The data in Table I demonstrates that the lubricant significantly reduces the static and kinetic coefficients of friction between cable and conduit.

TABLE 1

| | Conduits | | | | | |
|---|---|---|---|---|---|---|
| | Polyethylene (flat) | | Polyethylene (Corrugated) | | Polyvinyl Chloride (Corrugated) | |
| Cable | $u_S$ | $u_K$ | $u_S$ | $u_K$ | $u_S$ | $u_K$ |
| Siecor | | | | | | |
| Lubricated (100 lb/ft) | 0.20 | 0.20 | 0.15 | 0.13 | 0.14 | 0.115 |
| Bare (20 lb/ft) | 0.95 | 0.85 | — | — | — | — |
| Western Electric | | | | | | |
| Lubricated (100 lb/ft) | 0.15 | 0.15 | 0.10 | 0.09 | 0.15 | 0.09 |
| Bare | — | — | — | — | — | — |

EXAMPLE V

Lubricant was formed in accordance with the procedure of Example III. An excess of the lubricant was coated onto 6-inch long cables made of polyvinyl chloride (PVC), crosslinked polyethylene (XLP), nylon, and HYPALON® (E. I. DuPont de Nemours & Co.). Utilizing the apparatus and method described in Example IV, the coated cables were each pulled through a 2 inch inside diameter polyvinyl chloride (PVC) conduit and a 2 inch inside diameter electrometallic (EMT) conduit. A sidewall force of 100 lb/ft was applied. The static ($u_S$) and kinetic ($u_K$) coefficients of friction were calculated for each cable and conduit combination. Results of the tests are tabulated in Table 2.

For comparison purposes, the static and kinetic coefficients of friction were calculated for nonlubricated cable utilizing the apparatus and method disclosed in Example IV. However, because the apparatus was not equipped with sufficient pulling force to move the nonlubricated cable under 100 lb/ft sidewall force (maximum pulling force is about 30 lbs.) the coefficients of friction were calculated under a smaller sidewall force.

The data shown in Table 6 demonstrates that the lubricant significantly reduces the static and kinetic coefficients of of friction between cable and conduit.

TABLE 2

| | Conduits | | | |
|---|---|---|---|---|
| | PVC | | EMT | |
| Cables | $u_S$ | $u_K$ | $u_S$ | $u_K$ |
| PVC | | | | |
| Lubricated (100 lb/ft) | 0.17 | 0.13 | 0.19 | 0.15 |
| Bare | | | | |
| (20 lb/ft) | 0.90 | 0.70 | | |
| (40 lb/ft) | | | 0.55 | 0.54 |
| XLP | | | | |
| Lubricated (100 lb/ft) | 0.16 | 0.13 | 0.12 | 0.12 |
| Bare | | | | |
| (20 lb/ft) | 0.90 | 0.80 | | |
| (40 lb/ft) | | | 0.65 | 0.59 |
| Nylon | | | | |
| Lubricated (100 lb/ft) | 0.13 | 0.11 | 0.20 | 0.18 |
| Bare | — | — | — | — |
| HYPALON® | | | | |
| Lubricated (100 lb/ft) | 0.11 | 0.10 | 0.15 | 0.125 |
| Bare (10 lb/ft) | 2.0 | — | 1.0 | — |

EXAMPLE VI

Lubricant was formed in accordance with the procedure of Example III except that it included 30 ml polyethylene glycol and no polypropylene glycol. An excess of the lubricant was coated onto 6-inch long cables made of polyvinyl chloride (PVC), crosslinked polyethylene (XLP), nylon, HYPALON® (E. I. DuPont de Nemours & Co.) and Neoprene. Utilizing the apparatus and method described in Example IV, the coated cables were each pulled through a 2 inch inside diameter polyvinyl chloride (PVC) conduit and a 2 inch inside diameter electrometallic (EMT) conduit. A sidewall force of 100 lb/ft was applied. The static ($u_S$) and kinetic ($u_K$) coefficients of friction were calculated for each cable and conduit combination. Results of the tests are tabulated in Table 3.

For comparisobn purposes, the static and kinetic coefficients of friction were calculated for nonlubricated cable utilizing the apparatus and method disclosed in Example IV. However, because the apparatus was not equipped with sufficient pulling force to move the nonlubricated cable under 100 lb/ft sidewall force (maximum pulling force is about 30 lbs.) the coefficients of friction were calculated under a smaller sidewall force.

The data shown in Table 3 demonstrates that the lubricant significantly reduces the static and kinetic coefficients of friction between cable and conduit.

TABLE 3

| Cables | Conduits PVC $u_S$ | PVC $u_K$ | EMT $u_S$ | EMT $u_K$ |
|---|---|---|---|---|
| PVC | | | | |
| Lubricated (100 lb/ft) | 0.25 | 0.15 | 0.40 | 0.31 |
| Bare | | | | |
| (20 lb/ft) | 0.90 | 0.70 | | |
| (40 lb/ft) | | | 0.55 | 0.54 |
| XLP | | | | |
| Lubricated (100 lb/ft) | 0.14 | 0.13 | 0.27 | 0.25 |
| Bare | | | | |
| (20 lb/ft) | 0.90 | 0.80 | | |
| (40 lb/ft) | | | 0.65 | 0.59 |
| Nylon | | | | |
| Lubricated (100 lb/ft) | 0.20 | 0.15 | 0.28 | 0.25 |
| Bare | — | — | — | — |
| HYPALON ® | | | | |
| Lubricated (100 lb/ft) | 0.13 | 0.10 | — | — |
| Bare (10 lb/ft) | 2.0 | — | 1.0 | — |
| Neoprene | | | | |
| Lubricated | 0.30 | 0.30 | — | — |
| Bare (10 lb/ft) | 2.6 | 1.9 | 1.2 | — |

EXAMPLE VII

Lubricant was formed in accordance with the procedure of Example III except that it included 15 ml polypropylene glycol and no polyethylene glycol. An excess of the lubricant was coated onto 6-inch long cables made of polyvinyl chloride (PVC), crosslinked polyethylene (XLP), nylon, HYPALON® (E. I. DuPont de Nemours & Co.) and Neoprene. Utilizing the apparatus and method described in Example IV, the coated cables were each pulled through a 2 inch inside diameter polyvinyl chloride (PVC) conduit and a 2 inch inside diameter electrometallic conduit (EMT). A sidewall force of 100 lb/ft was applied. The static ($u_S$) and kinetic ($u_K$) coefficients of friction were calculated for each cable and conduit combination. Results of the tests are tabulated in Table 4.

For comparison purposes, the static and kinetic coefficients of friction were calculated for nonlubricated cable utilizing the apparatus and method disclosed in Example IV. However, because the apparatus was not equipped with sufficient pulling force to move the nonlubricated cable under 100 lb/ft sidewall force (maximum pulling force is about 30 lbs.) the coefficients of friction were calculated under a smaller sidewall force.

The data shown in Table 4 demonstrates that the lubricant significantly reduces the static and kinetic coefficients of friction between cable and conduit.

TABLE 4

| Cables | Conduits PVC $u_S$ | PVC $u_K$ | EMT $u_S$ | EMT $u_K$ |
|---|---|---|---|---|
| PVC | | | | |
| Lubricated (100 lb/ft) | 0.13 | 0.10 | 0.32 | 0.18 |
| Bare | | | | |

TABLE 4-continued

| Cables | Conduits PVC $u_S$ | PVC $u_K$ | EMT $u_S$ | EMT $u_K$ |
|---|---|---|---|---|
| (20 lb/ft) | 0.90 | 0.70 | | |
| (40 lb/ft) | | | 0.55 | 0.54 |
| XLP | | | | |
| Lubricated (100 lb/ft) | 0.12 | 0.11 | 0.16 | 0.14 |
| Bare | | | | |
| (20 lb/ft) | 0.90 | 0.80 | | |
| (40 lb/ft) | | | 0.65 | 0.59 |
| Nylon | | | | |
| Lubricated (100 lb/ft) | 0.12 | 0.11 | 0.26 | 0.15 |
| Bare | — | — | — | — |
| HYPALON ® | | | | |
| Lubricated (100 lb/ft) | 0.09 | 0.08 | 0.35 | 0.35 |
| Bare (10 lb/ft) | 2.0 | — | 1.0 | — |
| Neoprene | | | | |
| Lubricated | 0.12 | 0.11 | 0.30 | 0.30 |
| Bare (10 lb/ft) | 2.6 | 1.9 | 1.2 | — |

EXAMPLE VIII

Lubricant was formed in accordance with the procedure of Example III except that it included 15 ml polypropylene glycol having a molecular weight of about 1,200 and no polyethylene glycol. An excess of the lubricant was coated onto 6-inch long cables made of polyvinyl chloride (PVC), crosslinked polyethylene (XLP), nylon, HYPALON® (E. I. DuPont de Nemours & Co.) and Neoprene and allowed to dry. Utilizing the apparatus and method described in Example IV, the coated cables were each pulled through a 2 inch inside diameter polyvinyl chloride (PVC) conduit and a 2 inch inside diameter electrometallic (EMT) conduit. A sidewall force of 100 lb/ft was applied. The static ($u_S$) and kinetic ($u_K$) coefficients of friction were calculated for each cable and conduit combination. Results of the tests are tabulated in Table 5.

For comparison purposes, the static and kinetic coefficients of friction were calculated for nonlubricated cable utilizing the apparatus and method disclosed in Example IV. However, because the apparatus was not equipped with sufficient pulling force to move the nonlubricated cable under 100 lb/ft sidewall force (maximum pulling force is about 30 lbs.) the coefficients of friction were calculated under a smaller sidewall force.

The data shown in Table 5 demonstrates that the lubricant significantly reduces the static and kinetic coefficients of friction between cable and conduit.

TABLE 5

| Cables | Conduits PVC $u_S$ | PVC $u_K$ | EMT $u_S$ | EMT $u_K$ |
|---|---|---|---|---|
| PVC | | | | |
| Lubricated (100 lb/ft) | 0.23 | 0.17 | 0.40 | 0.19 |
| Bare | | | | |
| (20 lb/ft) | 0.90 | 0.70 | | |
| (40 lb/ft) | | | 0.55 | 0.54 |
| XLP | | | | |
| Lubricated (100 lb/ft) | 0.24 | 0.15 | 0.28 | 0.18 |
| Bare | | | | |
| (20 lb/ft) | 0.90 | 0.80 | | |

TABLE 5-continued

| Cables | Conduits PVC $u_S$ | PVC $u_K$ | EMT $u_S$ | EMT $u_K$ |
|---|---|---|---|---|
| (40 lb/ft) | | | 0.65 | 0.59 |
| Nylon | | | | |
| Lubricated (100 lb/ft) | 0.24 | 0.15 | 0.27 | 0.17 |
| Bare | — | — | — | — |
| HYPALON ® | | | | |
| Lubricated (100 lb/ft) | 0.22 | 0.20 | 0.42 | 0.35 |
| Bare (10 lb/ft) | 2.0 | — | 1.0 | — |
| Neoprene | | | | |
| Lubricated | 0.22 | 0.20 | 0.40 | 0.35 |
| Bare (10 lb/ft) | 2.6 | 1.9 | 1.2 | — |

EXAMPLE IX

Lubricant was formed in accordance with the procedure of Example III except that it included 15 ml polypropylene glycol having a molecular weight of about 4,000 and no polyethylene glycol. An excess of the lubricant was coated onto 6-inch long cables made of polyvinyl chloride (PVC), crosslinked polyethylene (XLP), nylon, HYPALON® (E. I. DuPont de Nemours & Co.) and Neoprene and allowed to dry. Utilizing the apparatus and method described in Example IV, the coated cables were each pulled through a 2 inch inside diameter polyvinyl chloride (PVC) conduit and a 2 inch inside diameter electrometallic (EMT) conduit. A sidewall force of 100 lb/ft was applied. The static ($u_S$) and kinetic ($u_K$) coefficients of friction were calculated for each cable and conduit combination. Results of the tests are tabulated in Table 6.

For comparison purposes, the static and kinetic coefficients of friction were calculated for nonlubricated cable utilizing the apparatus and method disclosed in Example IV. However, because the apparatus was not equipped with sufficient pulling force to move the nonlubricated cable under 100 lb/ft sidewall force (maximum pulling force is about 30 lbs.) the coefficients of friction were calculated under a smaller sidewall force.

The data shown in Table 6 demonstrates that the lubricant significantly reduces the static and kinetic coefficients of friction between cable and conduit.

TABLE 6

| Cables | Conduits PVC $u_S$ | PVC $u_K$ | EMT $u_S$ | EMT $u_K$ |
|---|---|---|---|---|
| PVC | | | | |
| Lubricated (100 lb/ft) | 0.20 | 0.15 | 0.17 | 0.13 |
| Bare | | | | |
| (20 lb/ft) | 0.90 | 0.70 | | |
| (40 lb/ft) | | | 0.55 | 0.54 |
| XLP | | | | |
| Lubricated (100 lb/ft) | 0.14 | 0.12 | 0.15 | 0.13 |
| Bare | | | | |
| (20 lb/ft) | 0.90 | 0.80 | | |
| (40 lb/ft) | | | 0.65 | 0.59 |
| Nylon | | | | |
| Lubricated (100 lb/ft) | 0.17 | 0.10 | 0.26 | 0.13 |
| Bare | — | — | — | — |
| HYPALON ® | | | | |
| Lubricated | 0.20 | 0.20 | 0.25 | 0.25 |

TABLE 6-continued

| Cables | Conduits PVC $u_S$ | PVC $u_K$ | EMT $u_S$ | EMT $u_K$ |
|---|---|---|---|---|
| (100 lb/ft) | | | | |
| Bare | 2.0 | — | 1.0 | — |
| (10 lb/ft) | | | | |
| Neoprene | | | | |
| Lubricated | 0.20 | 0.20 | 0.30 | 0.30 |
| Bare | 2.6 | 1.9 | 1.2 | — |
| (10 lb/ft) | | | | |

I claim:

1. A fatty-acid-free lubricant consisting essentially of:
(a) about 0.5 to 25 wt-% polyalkylene glycol having a molecular weight of about 1,000 to 15,000;
(b) an effective gelling amount of a viscosity modifier consisting essentially of a mixture of at least two components selected from the group consisting of polymeric polyelectrolyte acrylate compounds, polyalkylene oxide compounds, polyacrylamide compounds and cellulosic compounds; and
(c) water.

2. The lubricant of claim 1 wherein the lubricant consists essentially of about 0.5 to 10 wt-% polyalkylene glycol.

3. The lubricant of claim 1 wherein the viscosity modifier consists essentially of:
(i) about 10–80 wt-% polymeric polyelectrolyte acrylate compound,
(ii) about 0–90 wt-% polyalkylene oxide compound,
(iii) about 0–90 wt-% polyacrylamide compound, and
(iv) about 0–90 wt-% cellulosic compound.

4. The lubricant of claim 3 wherein the polymeric polyelectrolyte acrylate compound is polyacrylic acid having a molecular weight of at least 3,000, the polyalkylene oxide compound is polyethylene oxide having a molecular weight of at least 300,000 and the polyacrylamide has a molecular weight of at least 100,000.

5. A method of lubricating cable to be installed in a conduit comprising the step of applying the lubricant of claim 3 to the interface between cable and conduit during introduction of the cable into the conduit.

6. The lubricant of claim 1 wherein:
(a) the polyalkylene glycol is about 0–50 wt-% polyethylene glycol having a molecular weight of about 1,000 to 15,000, and about 50–100 wt-% polypropylene glycol having a molecular weight of about 1,000 to 4,000; and
(b) the viscosity modifier is about 10–80 wt-% polyacrylic acid having a molecular weight of at least 3,000, about 20–90 wt-% polyethylene oxide having a molecular weight of at least 300,000 and about 20–90 wt-% cellulosic compound.

7. A method of lubricating cable to be installed in a conduit comprising the step of applying the lubricant of claim 6 to the interface between cable and conduit during introduction of the cable into the conduit.

8. The lubricant of claim 1 wherein:
(a) the polyalkylene glycol is about 0–50 wt-% polyethylene glycol having a molecular weight of about 1,000 to 15,000 and about 50–100 wt-% polypropylene glycol having a molecular weight of about 1,000 to 4,000; and
(b) the viscosity modifier is about 10–80 wt-% polyacrylic acid having a molecular weight of at least 3,000 and about 20–90 wt-% copolymer of acrylamide and an acrylic monomer having a pendent carboxyl group, having a molecular weight of at least 100,000.

9. A method of lubricating cable to be installed in a conduit comprising the step of applying the lubricant of claim 8 to the interface between cable and conduit during introduction of the cable into the conduit.

10. The lubricant of claim 1 wherein:

(a) the polyalkylene glycol is about 0–50 wt-% polyethylene glycol having a molecular weight of about 1,000 to 15,000 and about 50–100 wt-% polypropylene glycol having a molecular weight of about 1,000 to 4,000; and (b) the viscosity modifier is about 10–80 wt-% polyacrylic acid having a molecular weight of at least 3,000 and about 20–90 wt-% cellulosic compound.

11. A method of lubricating cable to be installed in a conduit comprising the step of applying the lubricant of claim 10 to the interface between cable and conduit during introduction of the cable into the conduit.

12. A method of lubricating cable to be installed in a conduit comprising the step of applying the lubricant of claim 1 to the interface between cable and conduit during introduction of the cable into the conduit.

13. The lubricant of claim 1 wherein the viscosity modifier consists essentially of:

(i) about 0–80 wt-% polymeric polyelectrolyte acrylate compound, (ii) about 20–90 wt-% polyalkylene oxide compound, (iii) about 0–90 wt-% polyacrylamide compound, and (iv) about 0–90 wt-% cellulosic compound.

14. A method of lubricating cable to be installed in a conduit comprising the step of applying the lubricant of claim 13, to the interface between cable and conduit during introduction of the cable into the conduit.

15. The lubricant of claim 1 wherein the viscosity modifier consists essentially of:

(i) about 0–80 wt-% polymeric polyelectrolyte acrylate compound, (ii) about 0–90 wt-% polyalkylene oxide compound, (iii) about 0–90 wt-% polyacrylamide compound, and (iv) about 20–90 wt-% cellulosic compound.

16. A method of lubricating cable to be installed in a conduit comprising the step of applying the lubricant of claim 15 to the interface between cable and conduit during introduction of the cable into the conduit.

17. The lubricant of claim 1 wherein the polymeric polyelectrolyte acrylate compound is polyacrylic acid having a molecular weight of at least 3,000, the polyalkylene oxide compound is polyethylene oxide having a molecular weight of at least 300,000 and the polyacrylamide has a molecular weight of at least 100,000.

18. The lubricant of claim 1 wherein:

(a) the polyalkylene glycol is about 0–50 wt-% polyethylene glycol having a molecular weight of about 1,000 to 15,000 and about 50–100 wt-% polypropylene glycol having a molecular weight of about 1,000 to 4,000; and (b) the viscosity modifier is about 10–80 wt-% polyacrylic acid having a molecular weight of at least 3,000 and about 20–90 wt-% polyethylene oxide having a molecular weight of at least 300,000.

19. A method of lubricating cable to be installed in a conduit comprising the step of applying the lubricant of claim 18 to the interface between cable and conduit during introduction of the cable into the conduit.

20. A fatty-acid-free lubricant consisting essentially of:

(a) about 0.5 to 25 wt-% polyalkylene glycol having a molecular weight of about 1,000–15,000;

(b) an effective gelling amount of a viscosity modifier consisting essentially of a mixture of at least two components selected from the group consisting of polymeric polyelectrolyte acrylate compounds, polyalkylene oxide compounds, polyacrylamide compounds and cellulosic compounds;

(c) an effective antioxidant, solubilizing and freezing point depressing amount of a $C_{1-6}$ alcohol; and (d) water.

21. The lubricant of claim 20 wherein the $C_{1-6}$ alcohol is methanol, ethanol, isopropanol, ethylene glycol, propylene glycol, amyl alcohol, or n-hexanol.

22. The lubricant of claim 21 wherein the lubricant is about 10 to 80 wt-% $C_{1-6}$ alcohol to form a freeze resistant lubricant.

23. A method of lubricating cable to be installed in a conduit comprising the step of applying the lubricant of claim 20 to the interface between cable and conduit during introduction of the cable into the conduit.

24. The lubricant of claim 20 wherein the viscosity modifier consists essentially of:

(i) about 10–80 wt-% polymeric polyelectrolyte acrylate compound, (ii) about 0–90 wt-% polyalkylene oxide compound, (iii) about 0–90 wt-% polyacrylamide compound, and (iv) about 0–90 wt-% cellulosic compound.

25. The lubricant of claim 24 wherein the polymeric polyelectrolyte acrylate compound is polyacrylic acid having a molecular weight of at least 3,000, the polyalkylene oxide compound is polyethylene oxide having a molecular weight of at least 300,000, and the polyacrylamide has a molecular weight of at least 100,000.

* * * * *